US006664929B2

(12) United States Patent
Ye

(10) Patent No.: US 6,664,929 B2
(45) Date of Patent: Dec. 16, 2003

(54) FLAT TYPED ASSEMBLING STRUCTURE FOR ANTENNA

(75) Inventor: Wei Ye, Chung-Li (TW)

(73) Assignee: Auden Techno Corp.,, Tai-Yuan Hsien (TW)

( * ) Notice: Subject to any disclaimer, the term of this patent is extended or adjusted under 35 U.S.C. 154(b) by 0 days.

(21) Appl. No.: 10/106,245

(22) Filed: Mar. 27, 2002

(65) Prior Publication Data

US 2003/0184481 A1 Oct. 2, 2003

(51) Int. Cl.[7] ..... H01Q 1/24
(52) U.S. Cl. ..... 343/702; 343/895
(58) Field of Search ..... 343/702, 895, 343/906, 749, 860, 900, 901; 455/40

(56) References Cited

U.S. PATENT DOCUMENTS 5,699,070 A * 12/1997 Mischenko et al. ..... 343/702

6,476,777 B1 * 11/2002 Lin et al. ..... 343/895

* cited by examiner

*Primary Examiner*—James Clinger
(74) *Attorney, Agent, or Firm*—Troxell Law Office PLLC

(57) ABSTRACT

The flat typed assembling structure comprises an external insulating sleeve, an inner insulating sleeve adapted to assembling in the external insulating sleeve, a coil with a specified diameter positioned between the inner and external insulating sleeves, and a top lid connected with the top of the external insulating sleeve; wherein, the outer surface of the inner insulating sleeve and the inner wall of the external insulation sleeve are provided respectively with convex annular ribs and concave annular recesses for connecting of the sleeves; the inner insulating sleeve has its front and rear sides both flattened to leave a front and a rear opening, to form an internal receiving space to receive therein the coil; a guiding and connecting stub is provided at the bottom of the internal receiving space, so that the coil can be positioned between the guiding and connecting stub and the bottom end of the top lid.

4 Claims, 4 Drawing Sheets

FLAT TYPED ASSEMBLING STRUCTURE FOR ANTENNA

BACKGROUND OF THE INVENTION

1. Field of the Invention

The present invention is related to a flat typed assembling structure for an antenna, and especially to a structure which is suitable for connecting of an inner insulation sleeve with an external insulation sleeve for an antenna in a mobile phone, and can make such connecting more stable and reliable, thereby, convenience in processing can be obtained.

2. Description of the Prior Art

Antennas for mobile phones are divided generally into two kinds, they are the extension type and the fixed type, whichever the type they belong to, antennas for mobile phones are necessary to be miniaturized in meeting the tendency of miniaturization of mobile phones for convenience of carrying. Particularly, miniaturized fixed antennas must have their coils, contact pieces of receiving seats etc. mounted between an inner insulation sleeve and an external insulation sleeve, then the inner and external insulation sleeves are proceeded to connecting.

The earlier mobile phones of such kind have their inner insulation and external sleeves connected by applying glue; this mode has the following defects:

1. Sizing must wait for curing for connecting, and the structural strength thereof is inferior, the amount of glue in sizing and the areas of connecting are normally uncertain, thereby, quality of connecting of this mode is unstable.
2. Sizing at the connecting areas between an inner insulation sleeve and an external insulation sleeve results inferior structural strength, and such structural strength is not desired.
3. The chemical nature of such connecting glue generally include corrosion,; it tends to destroy the entire structure of an antenna after using for a long period of time.

Sizing for connecting an inner insulation sleeve and an external insulation sleeve of an antenna can have the advantage of fast processing; however, it has the disadvantage of inferior structural strength. There is an injection enveloping-shaping method among the processing methods now available, the coil of an antenna must be placed upright and abutted against the external insulation sleeve and a receiving seat, this is just like the case of the structure of the antenna structure connected by sizing, the helix coil positioned and enveloped in the inner and external insulation sleeves resulted from this injection enveloping-shaping method is very unstable, and thereby the inferiority of such products is overly high.

And more, such antennas for mobile phones are mostly of the cylindrical structure, connecting of the inner and external insulation sleeves can be any of various ones to make connecting between the mutually confronting cylindrical walls of the sleeves. The antennas for mobile phones of this kind available now may have various shapes in designing, for example, an antenna structure can be flat which is more beautiful apparently, in this structure, the inner and external insulation sleeves are structurally varied.

SUMMARY OF THE INVENTION

The object of the present invention is to provide a flat typed assembling structure for an antenna, it has an inner insulation sleeve in the shape of a cylinder with its front and rear sides both flattened to be in the shape of a straight plane, and has an external insulation sleeve capable of connecting by slipping over the inner insulation sleeve. A top lid can be cooperatively installed on the top of the external insulation sleeve, the inner end face thereof and the inner insulation sleeve together can position the upper and the lower ends of an internal coil. The inner and the external insulation sleeves can be provided with convex annular ribs and concave annular recesses for connecting of them, to form a more stable and reliable structure which is convenient for processing.

The present invention will be apparent in its novelty and other characteristics after reading the detailed description of the preferred embodiment thereof in reference to the accompanying drawings.

DETAILED DESCRIPTION OF THE PREFERRED EMBODIMENT

Figure 1:
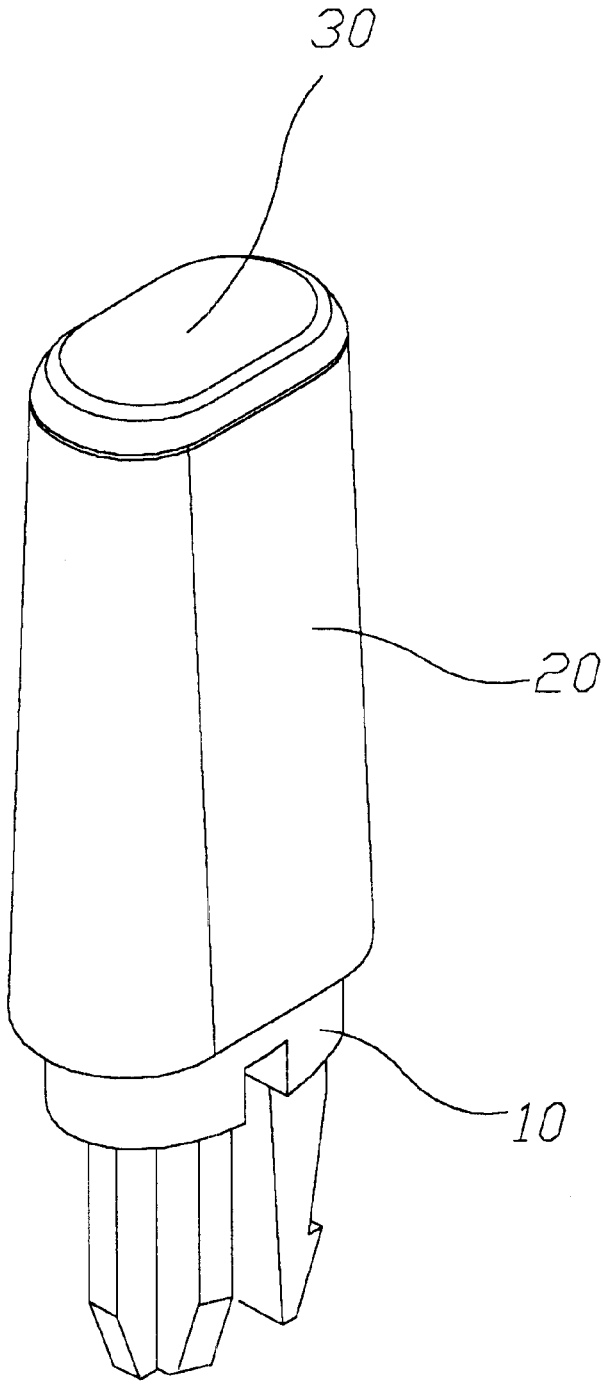
FIG. 1 is a perspective view of a preferred embodiment of present invention.

Referring to the drawings, the antenna of the present invention is comprised of an inner insulating sleeve 10, an external insulating sleeve 20, a top lid 30 and an internal coil 40.

The inner insulating sleeve 10 is provided in correspondence in shape with the external insulating sleeve 20 with a seat portion 11 having thereon a cylindrical hollow member 12 with its front and rear sides 13, 14 both flattened to be in the shape of a straight plane to thereby leave a front opening 15 and a rear opening 16, a guiding and connecting stub 17 is provided in the hollow member 12 for placing therein the lower end of the positioning internal coil 40. The structure is advantageous in that, the flattened front and rear sides 13, 14 of the cylindrical hollow member 12 still allow an internal receiving space to be formed to receive therein the coil with a desired specified diameter (4.5 mm) to maintain the electric characteristics of the antenna. The outer surface of the cylindrical hollow member 12 is provided with a plurality of convex ribs. In the preferred embodiment shown, there are a top convex rib 18 and two middle convex ribs 191, 192. The middle convex ribs 191, 192 are most preferably provided each with an upper inclined guide surface 193 and a lower horizontal surface 194 to be favorable for insertion connecting on the one hand and for to prevent from separating by an axial force when in engaging on the other hand.

The external insulating sleeve 20 is generally a hollow member with a flat cross section, the top surface 21 thereof is provided with a hole 22, while the bottom thereof is opened, the inner vertical wall thereof is provided with a plurality of concave annular recesses 28, 291, 292 for connecting with the inner insulating sleeve 10. Thereby, the inner and the external insulating sleeves 10, 20 can be insertion connected with each other.

The top lid 30 is preferably plated with chromium, and is provided on the bottom thereof with an engaging means 31 mating with the hole 22 of the external insulating sleeve 20.

Figure 2:
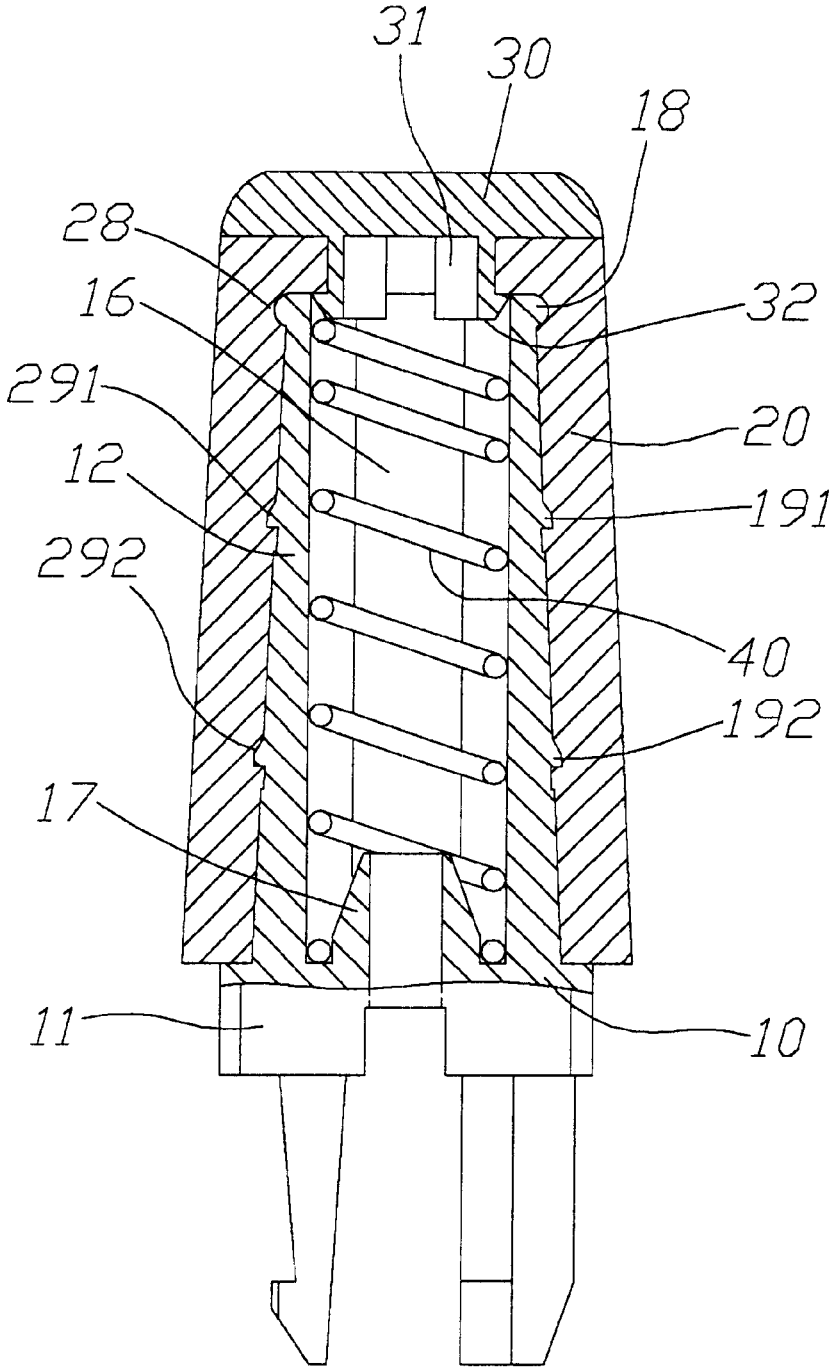
FIG. 2 is a sectional view taken from FIG. 2.
Figure 3:
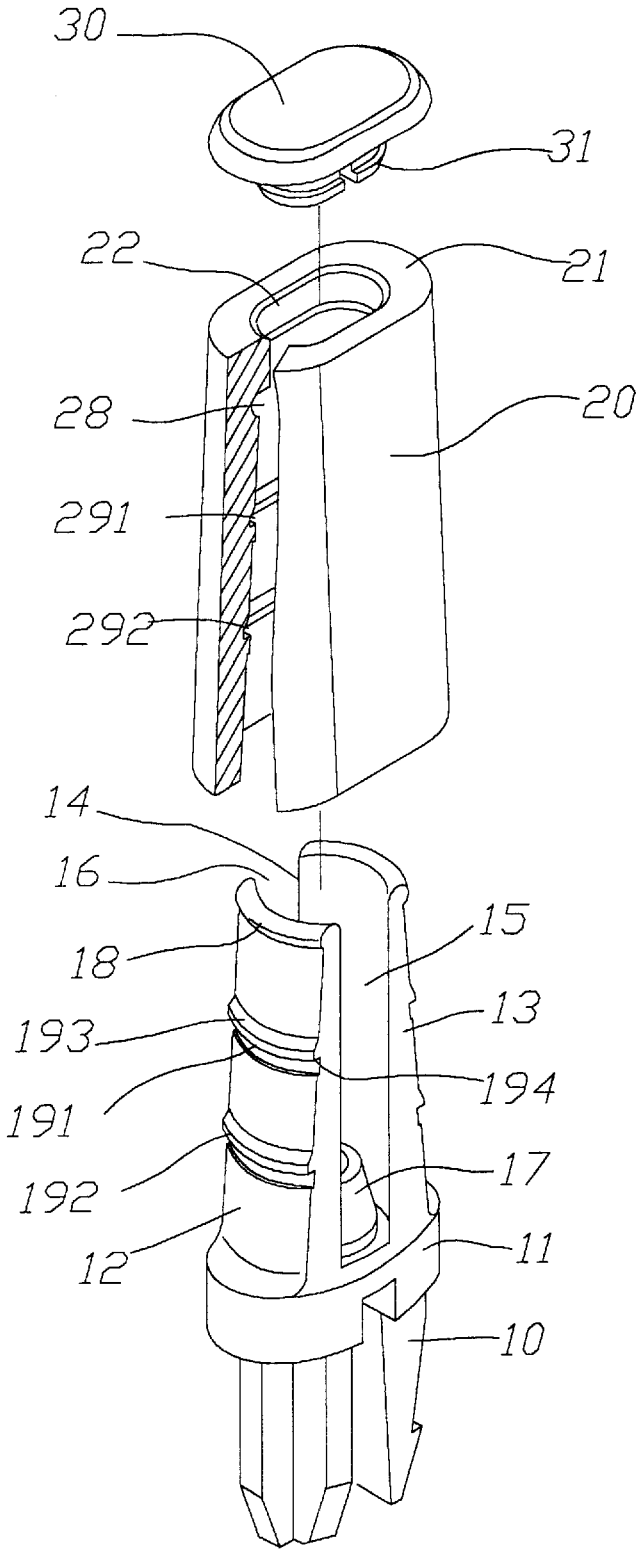
FIG. 3 is an anatomic perspective view showing the elements of the preferred embodiment of FIG. 1 excluding the internal coil.
Figure 4:
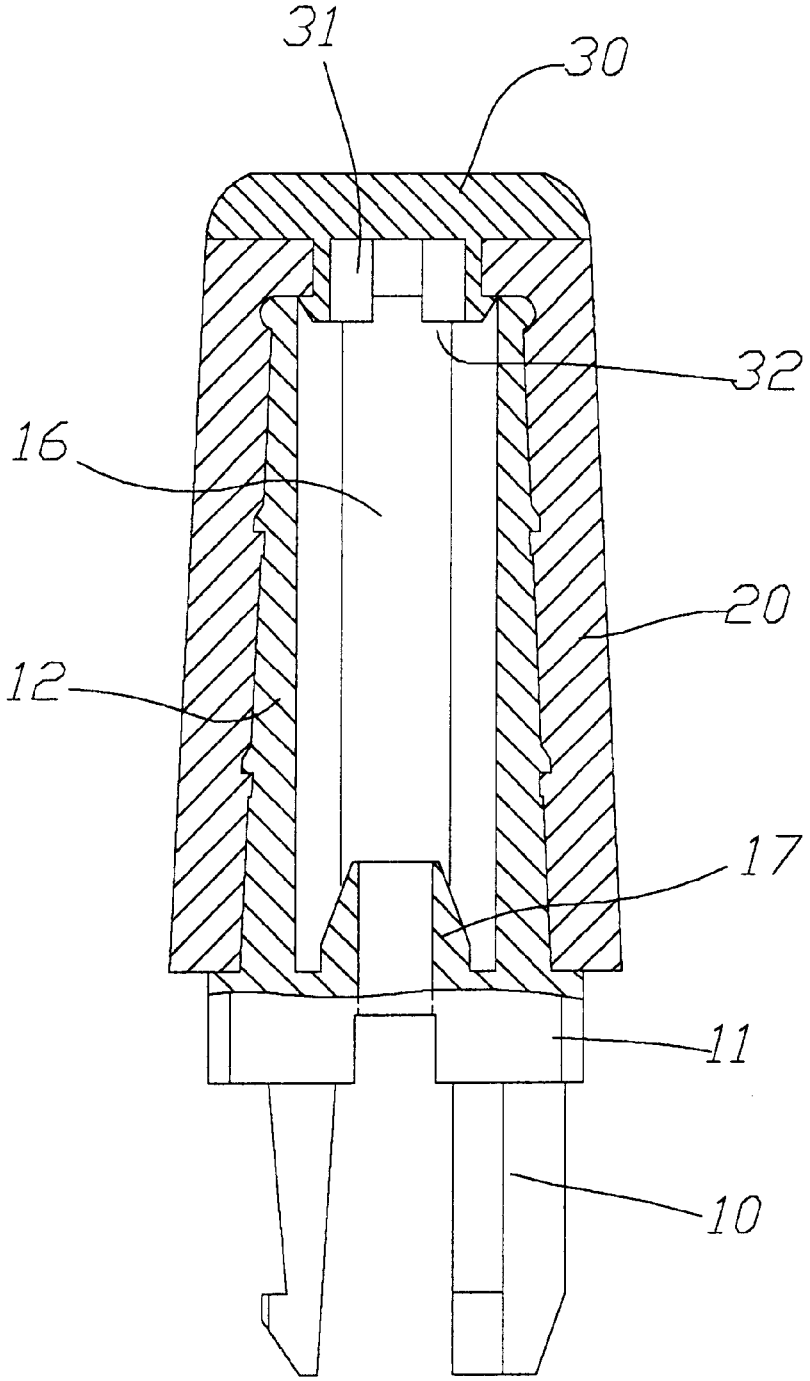
FIG. 4 is a sectional view taken from FIG. 3 when the present invention is assembled.

So that when the top lid 30 is connected with the top of the external insulating sleeve 20, the inner end face 32 thereof together with the guiding and connecting stub 17 can make positioning of the upper and the lower ends of the internal coil 40 (referring to FIG. 2).

The inner and the external insulating sleeves 10, 20 of the present invention can thereby be insertion connected with each other directly. During insertion connecting, the two middle convex ribs 191, 192 of the inner insulating sleeve 10 slightly expand the external insulating sleeve 20, and then get in their corresponding concave annular recesses 291, 292; then by elastic restoring of the material of the external insulating sleeve 20, the inner and the external insulating sleeves 10, 20 can be engaged and positioned by each other. After the two middle convex ribs 191, 192 with their corresponding upper inclined guide surfaces 193 and the lower horizontal surfaces 194 are engaged with the concave annular recesses 291, 292, the lower horizontal surfaces 194 form protruding engaging portions to thereby effectively prevent the inner and the external insulating sleeves 10, 20 of the whole antenna from separating by an axial pulling force.

The present invention thereby can be directly assembled by insertion connecting after injection shaping of the components thereof without additional procedure or equipment for processing. The flat typed antenna assembling structure can thereby firmer and more durable for use.

Having thus described the technical process of my invention having high industrial value, what I claim as new and desire to be secured by Letters Patent of the United States are:

1. A flat assembling structure for an antenna comprising:

a) an external insulating sleeve having:

i) a hollow interior;

ii) a top surface having a hole;

iii) an open bottom; and iv) a plurality of recesses formed on an interior surface of the hollow interior;

b) an inner insulating sleeve having:

i) a seat portion with a cylindrical hollow member, the seat portion having a flat front and a flat rear, the hollow member having a front opening in the flat front and a rear opening in the flat rear, the seat portion of the inner insulating sleeve being inserted into the hollow interior of the external insulating sleeve;

ii) a guiding and connecting member extending upwardly from a bottom of the hollow member;

iii) a plurality of convex ribs formed on an outer surface of the hollow member, such that the plurality of convex ribs on the inner insulating sleeve mate with and engage the plurality of recesses on the external insulating sleeve thereby connecting the external insulation sleeve to the inner insulating sleeve;

c) a top lid having an engaging device and an inner end face, the engaging device connecting the top lid to the hole on the top surface of the external insulating sleeve such that the top lid covers the hole; and d) an internal coil connected at opposing ends thereof to the connecting stub of the inner insulating sleeve and the inner end face of the top lid.

2. The flat assembling structure for an antenna according to claim 1, wherein the plurality of convex ribs formed on the outer surface of the inner insulating sleeve including a top convex rib and two middle convex ribs, and the plurality of annular recesses formed on the external insulating sleeve include a top recess and two middle annular recesses, and each of the two middle convex ribs have an upper inclined guide surface and a lower inclined guide surface.

3. The flat assembling structure for an antenna according to claim 1, wherein the hollow member is sized to accommodate an internal coil with a diameter of 4.5 mm.

4. The flat assembling structure for an antenna according to claim 1, wherein the top lid is plated with chromium.

* * * * *